United States Patent [19]

Radek

[11] Patent Number: 4,533,981

[45] Date of Patent: Aug. 6, 1985

[54] LIGHT CORNICE

[75] Inventor: John R. Radek, Hinsdale, Ill.

[73] Assignee: Ready Metal Manufacturing Company, Chicago, Ill.

[21] Appl. No.: 408,609

[22] Filed: Aug. 16, 1982

[51] Int. Cl.[3] ..... F21S 1/02

[52] U.S. Cl. ..... 362/151; 362/217; 362/432

[58] Field of Search ..... 362/33, 34, 84, 97, 362/125, 145, 147, 148, 150, 151, 217, 225, 404, 418, 419, 432, 396; 160/38, 39, 32, 197, 202, 236; 52/79.5, 579, 578, 588; 160/238, 229 R; D25/55, 58, 60, 4, 80

[56] References Cited

U.S. PATENT DOCUMENTS

| | | | |
|---|---|---|---|
| 1,628,511 | 5/1927 | Petersen | 160/32 |
| 2,296,782 | 9/1942 | Fischer et al. | 160/34 |
| 2,526,806 | 10/1950 | Charbonneau | 160/38 |
| 2,604,155 | 7/1952 | Junkunc | 160/38 |
| 2,638,162 | 5/1953 | Heitlinger et al. | 160/38 |
| 2,672,192 | 3/1954 | Goldner | 160/32 |
| 2,824,606 | 2/1958 | Lorentzen | 160/38 |
| 3,420,029 | 1/1969 | Martin | D25/80 |
| 3,969,866 | 7/1976 | Kyre | 52/588 |
| 4,193,239 | 3/1980 | Barto | D25/80 |

FOREIGN PATENT DOCUMENTS

| | | | |
|---|---|---|---|
| 0685781 | 9/1979 | U.S.S.R. | 52/79.5 |

OTHER PUBLICATIONS

Application Manual for Solid Vinyl Siding and Soffit Systems, Celotex Corporation, May 3, 1981, pp. 3 and 9.

*Primary Examiner*—William A. Cuchlinski, Jr.
*Attorney, Agent, or Firm*—Samuel Lebowitz

[57] ABSTRACT

A cornice designed especially for illuminating a wall of a retail store or the like, of knockdown construction for quick and easy erection and demounting. This invention is an improvement over that disclosed and claimed in my U.S. Pat. No. 4,251,855 issued Feb. 17, 1981. Like my patented invention, units in the instant case are tailored to fit a specific installation with a minimum of on site labor and little or no material waste. A major improvement in this case comprises means facilitating multiplying the vertical dimension of a cornice embodying my invention. This is accomplished by nesting together, in upper/lower relation, a pair of similar cornice units, as by interengaging marginal flanges at the upper and lower edges of the respective units. Accidental displacement may be insured against by such means as resilient tangs or prongs on one unit bearing yieldingly against an adjacent face of the mating unit. Security against inadvertent displacement may be insured against by such means as screws used in combination with the resilient elements or alone.

2 Claims, 3 Drawing Figures

LIGHT CORNICE

My invention relates to "hanging" panels known in the trade as cornices or light cornices, and used primarily in retail merchandising establishments such as department stores for support of lighting equipment illuminating a wall and for display of signs and the like.

The present invention may be considered an improvement on my U.S. Pat. No. 4,251,855 granted Feb. 17, 1981.

As in my prior invention, my improvement has to do with a prefabricated cornice designed to fit a particular installation as a modular unit capable of quick and easy erection with a minimum of labor and waste material and easy demounting, reducing cost.

BACKGROUND

Devices of the character of the present invention have, in general, been known and used heretofore. Prior to my patented invention, such equipment was usually constructed on the individual job at considerable expense because of extensive on-site labor and wasted material.

The most pertinent prior art, to my knowledge, is my said issued patent and the references cited therein.

BRIEF OUTLINE OF THE INVENTION

Generally speaking, and in basic detail, the present invention is essentially similar to my aforesaid patent, except as particularly pointed out.

It sometimes happens, in planning a retail store display, that available cornice panels are of inadequate depth (vertical dimension) to meet the demands of an installation. Though my original invention permits lateral extension to any desired extent, including inside and outside corners of a room, it was not previously considered feasible to extend the vertical dimension of said panels.

An important improvement of the present invention lies in the provision of means for multiplying the vertical dimension of a cornice in a setup embodying my invention by manually interengaging a pair of my cornice panels in vertical, upper/lower relation, whereby one panel (the lower) depends or hangs from the upper panel. Such assembly may be accomplished by a simple manual operation without the need for hand tools.

More specifically, my cornice panels are provided with longitudinally extending channel-like flanges that are nested together in the aforesaid assembly operation.

My invention also contemplates provision of means on adjacent walls of said interengaging elements for insuring a firm connection between upper and lower panels, thus inhibiting rattle or possible disengagement as a result of building vibration. Preferably, such means comprise pointed threaded screw fasteners along the bottom edge of the upper panel which extend therethrough and engage a flange on the lower panel, along the top edge of the latter.

Other objects and advantages may become apparent to those skilled in the art as the description proceeds.

BRIEF DESCRIPTION OF DRAWINGS

Referring now to the drawings forming a part of this specification and illustrating preferred embodiments of my invention.

DETAILED DESCRIPTION

It should be understood that, for purposes of simplifying the description, certain details of construction are omitted here, such details being essentially similar if not identical to corresponding elements described and shown in my patent cited hereabove, which disclosure is made a part hereof by reference.

Figure 1:
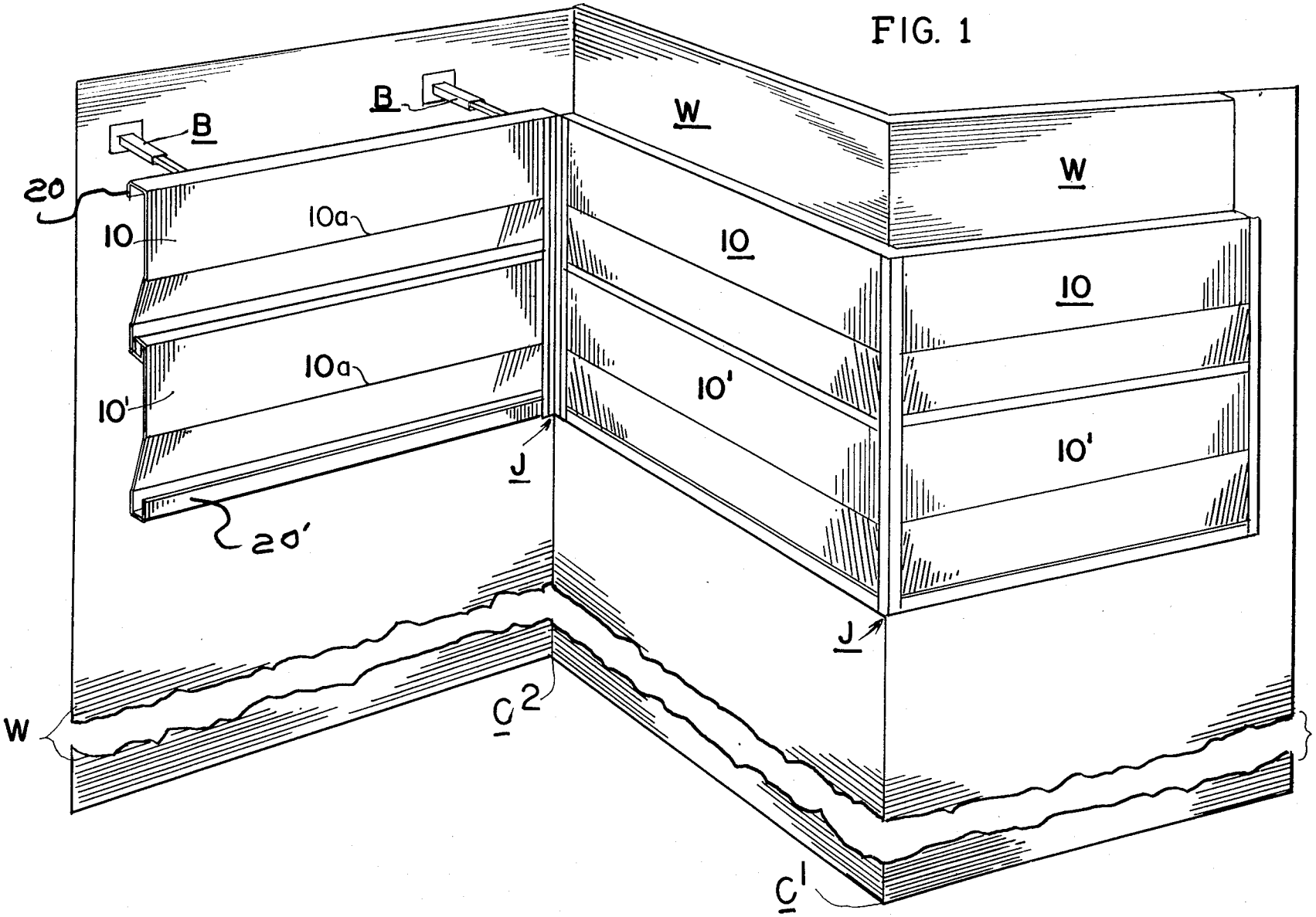
FIG. 1 is a fragmentary perspective view of a cornice setup embodying my invention mounted in a room including an inside and an outside corner, and vertically extended in accordance with my invention.

Referring first to FIG. 1, my invention is shown as applied to a wall having an outside and an inside corner $C_1$ and $C_2$, respectively. The cornice is vertically duplicated, i.e., with a lower cornice attached to and depending from the upper cornice as seen on the left-hand side of FIG. 1 by interengaging U-shaped flanges 20, 20' nested together at the adjoining edges of the respective upper and lower cornice members. The integral channel members 20,20', terminating in vertical flanges, are of substantially rectangular cross-section and provide substantial areas of contact between the vertical legs of the interengaging channel members when they are in nested relation. The securement of this nested relation of the channels, to inhibit rattle and inadvertent displacement of the panels, is effected by pointed threaded screw fasteners 51 (FIG. 3), along the bottom edge of the upper panel which penetrate the rear face of the latter to bring the pointed ends into engagement with the vertical flange of the channel of the lower panel which nests within the bottom channel of the upper panel.

Figure 2:
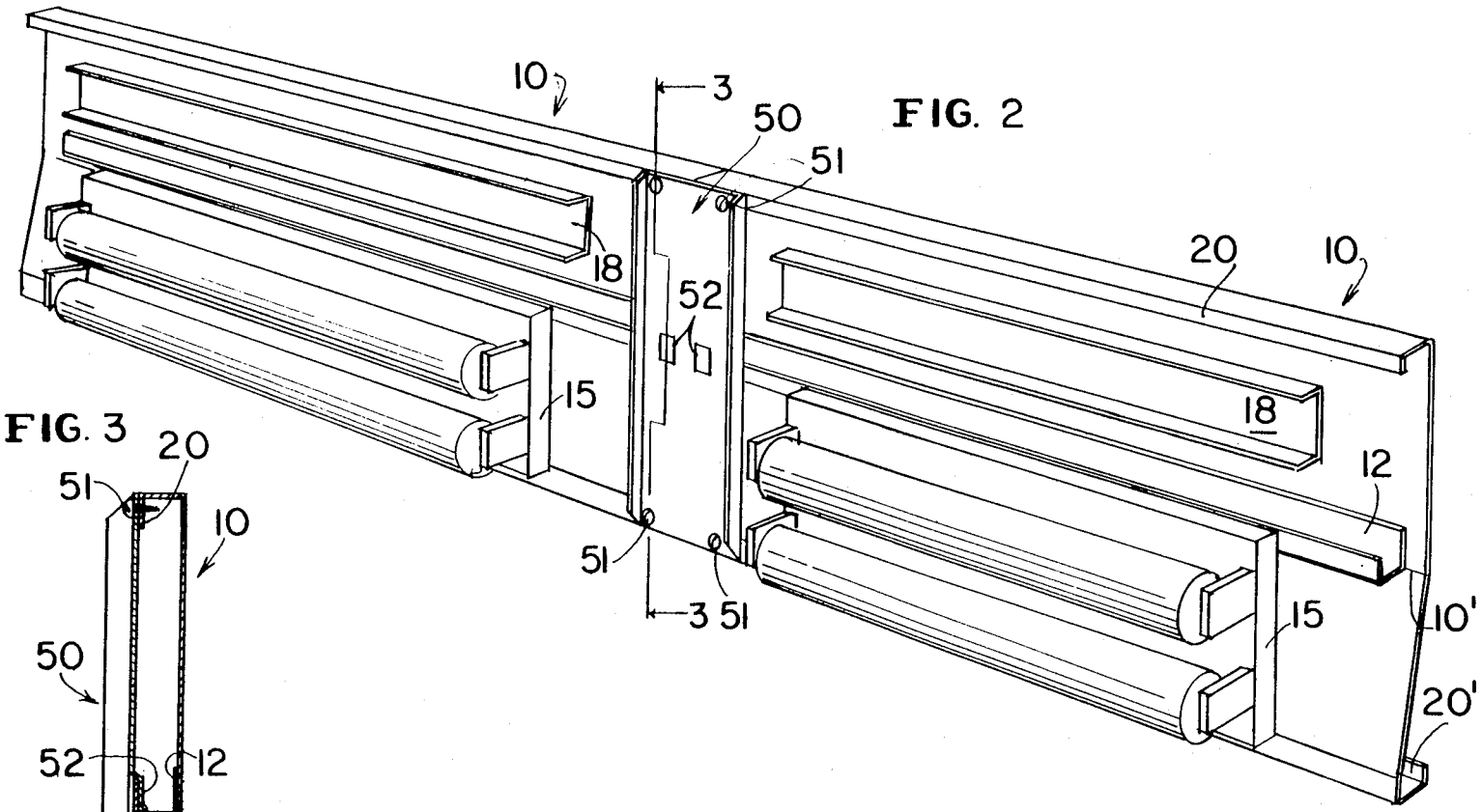
FIG. 2 is a rear perspective view showing a pair of cornice members extended horizontally in a straight line, including my improved securing means.
Figure 3:
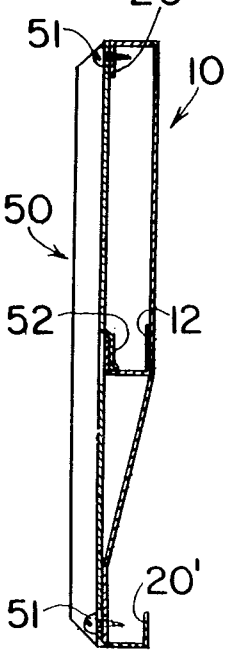
FIG. 3 is a vertical sectional view taken substantially along line 3—3 of FIG. 2.

FIGS. 2 and 3 show two pairs of panels, i.e., an upper and a lower cornice panel 10 and 10', said pairs being horizontally alined and thus extended horizontally and vertically, with a juncture member or panel 50 therebetween, with lighting means secured to the rear faces of said cornice panels and including longitudinal U-bar 12. Resilient tabs or tongues 52 are struck out from juncture member 50 to bear yieldably against U-member 12.

The simple manual assembly of the lower cornice member 10' with upper member 10 by the interengagement of tongue 52 with U-bar 12 will be obvious.

FIG. 1 shows adjacent cornice panels in a variety of corner installations and provided with corner juncture members indicated generally by character J, strictly in accordance with my prior patent and requiring no further detail here.

My said patent also shows in detail cantilever devices for mounting the panels to struts adjacent a wall W (FIG. 1) including bracket members B,B secured to the rear faces of panels 10 and extending rearwardly therefrom. Details of these features and assembly thereof are as disclosed in my said patent.

My cornice comprises one or more panels 10 designed to be mounted adjacent a wall, alone or in series adjacent to each other in a straight line or angularly to each other.

Panel 10 may have a slight longitudinal bend 10*a* intermediate its top and bottom edges to bring the horizontal faces of the channel members 20 and 20' in overlying relation. Adjacent said bend is secured, as by welding or brazing, a longitudinal U-bar 12 or the like, (FIG. 2), serving as a stiffener and also as a hanger for a housing 15 for fluorescent lamps or other lighting devices.

Above bend 10*a* is secured to panel 10 a channel member 18 that may be of use in mounting the panel.

While my patent shows various arrangements for extending the cornice longitudinally in a straight line or angularly, around room corners, it does not provide for vertical extension of the cornice, as may sometimes be desired for increasing illumination area on a wall or other purposes. Such is a major feature of the present invention.

To extend vertically the effective operation of a cornice embodying my invention, one of such panels, which I shall refer to as a lower panel, is assembled with another similar panel referred to as an upper panel, by interengaging or nesting the top channel member of the lower panel with the bottom channel member of the upper panel as seen in FIG. 1, by a simple manual operation.

While such nesting would doubtless be adequate as a temporary expedient, it is not considered entirely satisfactory to meet permanent or semi-permanent requirements with the possibility of frequent vibration of buildings in urban areas from passing vehicular traffic, etc. Pointed screws 51, (FIG. 2), may be driven into the readily accessible rear face of the upper panel along the bottom edge thereof, as described above, for engagement with the flange at the top of the lower panel. This serves to secure the assembly against vibrations to render it permanent until such time as it becomes necessary to dismantle it by withdrawing the screws, and making possible the disengagement of the adjoining edges of the upper and lower panels.

Conclusion

It will be seen that I have provided various means for extending vertically light cornices embodying my invention, insuring against rattle or inadvertent displacement.

Various changes and modifications may suggest themselves to those skilled in the art without departing from the spirit of my invention. Hence, I do not wish to be limited to the specific forms shown or uses mentioned except to the extent indicated in the appended claims.

I claim:

1. An interior vertically extensible knockdown cornice construction for illuminating a retail store wall or the like, comprising (a) a horizontally extending panel of rigid sheet material disposed in a substantially vertical plane forwardly of said wall having front and rear faces, with a lighting fixture mounted on the rear face, (b) said panel having a horizontal integral channel member of substantially rectangular cross-section extending rearwardly from the plane of the vertical panel at the top thereof and terminating in a downwardly extending flange spaced from the rear face of said panel and a second integral parallel channel member of substantially rectangular cross-section at the bottom of the panel extending forwardly from the front face thereof and terminating in an upwardly extending flange spaced from said panel, (c) a depending second panel suspended from said first panel, substantially similar to the latter, having the rearwardly extending rectangular channel member at the top thereof nested closely within the forwardly extending rectangular channel at the bottom of said first panel for interengagement therewith and forming a substantially rigid joint therebetween, and (d) pointed threaded screw fasteners adapted to penetrate the readily accessible rear face of the first-mentioned panel and channel member along the bottom edge thereof for driving the pointed ends thereof into engagement with the downwardly extending flange of the channel nested therein, to clamp the second panel securely to said first panel.

2. A cornice construction as set forth in claim 1, wherein a slight longitudinal bend in each panel between the top and bottom edges thereof, imparts a slight rearward inclination to the lower portion of each panel to dispose the channels at the top and bottom thereof in overlying relation.

* * * * *